US005518436A

United States Patent [19]

Lund et al.

[11] Patent Number: 5,518,436

[45] Date of Patent: May 21, 1996

[54] TOY FIGURE AND MANIFOLD ASSEMBLY THEREFOR

[75] Inventors: Bruce D. Lund, Chicago, Ill.; Robert H. Yeager, Twinsburg, Ohio

[73] Assignee: Cap Toys Inc., Bedford Heights, Ohio

[21] Appl. No.: 273,381

[22] Filed: Jul. 11, 1994

[51] Int. Cl.[6] ..... A63H 33/40; A63H 3/02; A63H 3/36

[52] U.S. Cl. ..... 446/180; 446/369; 446/385; 137/596.2; 137/907

[58] Field of Search ..... 52/79.4, 79.5, 52/169.6, 169.2; 137/907, 860, 596.2, 103; 285/150; 446/176, 180, 183, 185, 197, 198, 320, 385, 369, 372, 386

[56] References Cited

U.S. PATENT DOCUMENTS

| | | | |
|---|---|---|---|
| 3,118,463 | 1/1964 | Lacart | 137/597 X |
| 3,238,599 | 3/1966 | Bauman | 446/320 X |
| 3,459,217 | 8/1969 | Callahan | 137/860 X |
| 3,480,039 | 11/1969 | Brannon et al. | 137/596.2 |
| 3,601,923 | 8/1971 | Rosenberg . | |
| 4,169,336 | 10/1979 | Kuhn . | |
| 4,236,347 | 12/1980 | Fauls . | |
| 4,346,704 | 8/1982 | Kulle | 137/860 X |
| 4,575,351 | 3/1986 | Gonzalez | 446/369 X |
| 4,576,585 | 3/1986 | Balogh et al. . | |
| 4,582,499 | 4/1986 | Saigo et al. | 446/372 X |
| 4,792,399 | 12/1988 | Haney et al. | 210/484 |
| 4,911,674 | 3/1990 | Cole | 446/224 |
| 4,932,919 | 6/1990 | Shapero . | |
| 5,279,330 | 1/1994 | Debush | 137/860 X |
| 5,297,980 | 3/1994 | Barthold | 446/180 |

FOREIGN PATENT DOCUMENTS 1566786 5/1980 United Kingdom .

OTHER PUBLICATIONS

"Pneumatic Structures—A Handbook of Inflatable Architecture", Thomas Herzog, published by Oxford University Press, 1976, pp. 52–53.

"Frankenbumps," Mego Corp., 1982.

Photograph of "Super Soaker 10"™ (manufactured by Larami Corp., 1993).

*Primary Examiner*—D. Neal Muir

*Attorney, Agent, or Firm*—Marshall, O'Toole, Gerstein, Murray & Borun

[57] ABSTRACT

A stretchable toy figure which preferably has the ability to be altered from a first, unposable state to a second, posable state by reducing the pressure on the interior of the toy figure. The reduced pressure can also preferably alter the appearance of the toy figure. A manifold assembly for reducing the pressure on the interior of a toy figure includes two one-way valves. A valve through which air may be removed from the interior of the manifold includes a knob adapted to be associated with a device for reducing pressure. A second valve, when opened by a switch, allows air to enter the interior of the manifold when the pressure therein is below ambient pressure. The toy figure can alternatively utilize a single, two-way valve.

41 Claims, 3 Drawing Sheets

TOY FIGURE AND MANIFOLD ASSEMBLY THEREFOR

BACKGROUND OF THE INVENTION

1. Field of the Invention

The invention relates generally to a toy figure which has the ability to be stretchable and/or posable and, more particularly, the invention relates to a figure which has movable body parts and which may be altered by the user to be in a stretchable and posable state.

2. Brief Description of Related Technology

Many types of toy figures (e.g., dolls) have been made and marketed, including various types of toy figures which have the ability to perform assorted amusing and entertaining functions. Some of these toy figures have been made of materials which allow the toy figure to be stretched by the user of the toy.

For example, U.S. Pat. No. 4,169,336 to Kuhn (Oct. 2, 1979) discloses a toy figure having a skin of elastic film and a filling of a high viscosity material. The toy figure disclosed therein is stretchable, but once the stretching force is removed, the figure assumes its original shape and position. U.S. Pat. No. 3,601,923 to Rosenberg (Aug. 31, 1971) discloses an amusement device or toy which includes an elastic container in a desired configuration and a dilatant suspension inside the container.

Although the devices described above may be entertaining, it would be desirable to provide a figure which can be stretched and posed, including the ability to pose the figure in a stretched state. It would also be desirable to provide a figure which the user may alter from an unposable and/or unstretchable state to a posable and/or stretchable state.

SUMMARY OF THE INVENTION

The invention provides a toy figure which can be altered from a first state to a second, posable state. The toy figure includes an exterior shell or skin, at least a portion of which is made of a flexible material and defines a substantially airtight interior of the toy figure. A filler (e.g., a granular material) is disposed in the interior of the figure. The pressure in the interior of the figure can be reduced to a sub-ambient (e.g., sub-atmospheric) pressure in order to render the figure posable.

In one embodiment, the inventive toy figure includes a substantially airtight body portion made of a flexible material, preferably having stretchable limbs, and filled with a suitable material. At a location either on the body or attached to the body (preferably a head piece), there is provided an expedient for reducing the pressure on the interior of the body to a sub-atmospheric pressure. The toy figure is preferably rendered posable when the pressure on the interior of the body is reduced to a sub-atmospheric pressure.

A system for reducing the pressure on the interior of a toy figure is also provided by the invention. The system, which is preferably adapted for placement within the head of a toy figure, can include a manifold assembly. The manifold assembly is preferably associated with another, at least substantially airtight body portion, such as the flexible body described above, for example. The manifold assembly preferably includes a first valve through which air may be removed from the interior of the manifold, and a second valve through which air may be allowed to enter into the interior of the manifold. The first valve is adapted to be associated with a device (e.g., a pump) which can reduce the pressure on the interior of the manifold. Alternatively, a single, two-way valve can be utilized. The manifold communicates with the interior of the flexible body. When the pressure on the interior of the manifold is sub-atmospheric, opening of the second valve (e.g., by triggering a switch) will cause air to enter the interior of the manifold, e.g., to reestablish atmospheric pressure therein.

Further objects and advantages of the invention will be apparent to those skilled in the art from the following detailed description and drawings, taken in conjunction with the appended claims.

DETAILED DESCRIPTION OF THE INVENTION

According to the invention, there is provided toy figure that preferably can be stretchable and posable and that preferably has the ability to be altered from one state or condition to another state or condition. For example, the toy figure preferably can be altered from an unposable or "relaxed" state to a state in which the figure has improved stretching characteristics and the ability to be posed in a desired position. Preferably, the invention provides a toy figure which has movable limbs and which may be altered by the user to be in a stretchable and posable state. As used herein, the term "stretchable" generally means the ability to be elongated, whether or not the stretched object returns back to its original position. Generally, the term "posable" refers to the ability to semi-permanently place an object (e.g., a limb) in a desired orientation or position. Thus, the ability to be posed includes, for example, both (a) the ability to raise an arm and have the arm remain raised and (b) the ability to stretch, or elongate, an arm and have it stay in that elongated position.

Generally, the inventive toy figure has an elastic exterior or skin, in the interior of which there is a filler material which is preferably in granular form. The exterior or skin of the toy figure is preferably at least substantially airtight. There is provided on the toy figure at least one valve through which the pressure on the interior of figure may be reduced to a sub-ambient pressure. When the pressure in the interior of the toy figure is reduced to a sub-ambient pressure, the toy figure preferably can be stretched and posed into a desired position by the user. The toy figure can be returned to its original state by allowing the pressure on the interior of the figure to return to ambient pressure through either the same or a different valve.

A preferred embodiment of the invention will now be described with reference to the drawings. However, it should be understood that although the inventive toy figure is illustrated as being in the form of an animal having limbs similar to a human, the inventive toy is not limited to such an embodiment. For example, the inventive toy may be in the form of any type of an animal or a plant. The inventive toy may also be in the form of an inanimate object, such as a ball, building, automobile, vehicle tires, or masks, for example. In addition, the inventive toy figure is not limited to any particular size; the size of the inventive toy figure may, for example, range from small enough to fit in the palm of a hand to much larger size, e.g., three feet in length or larger.

Figure 1:
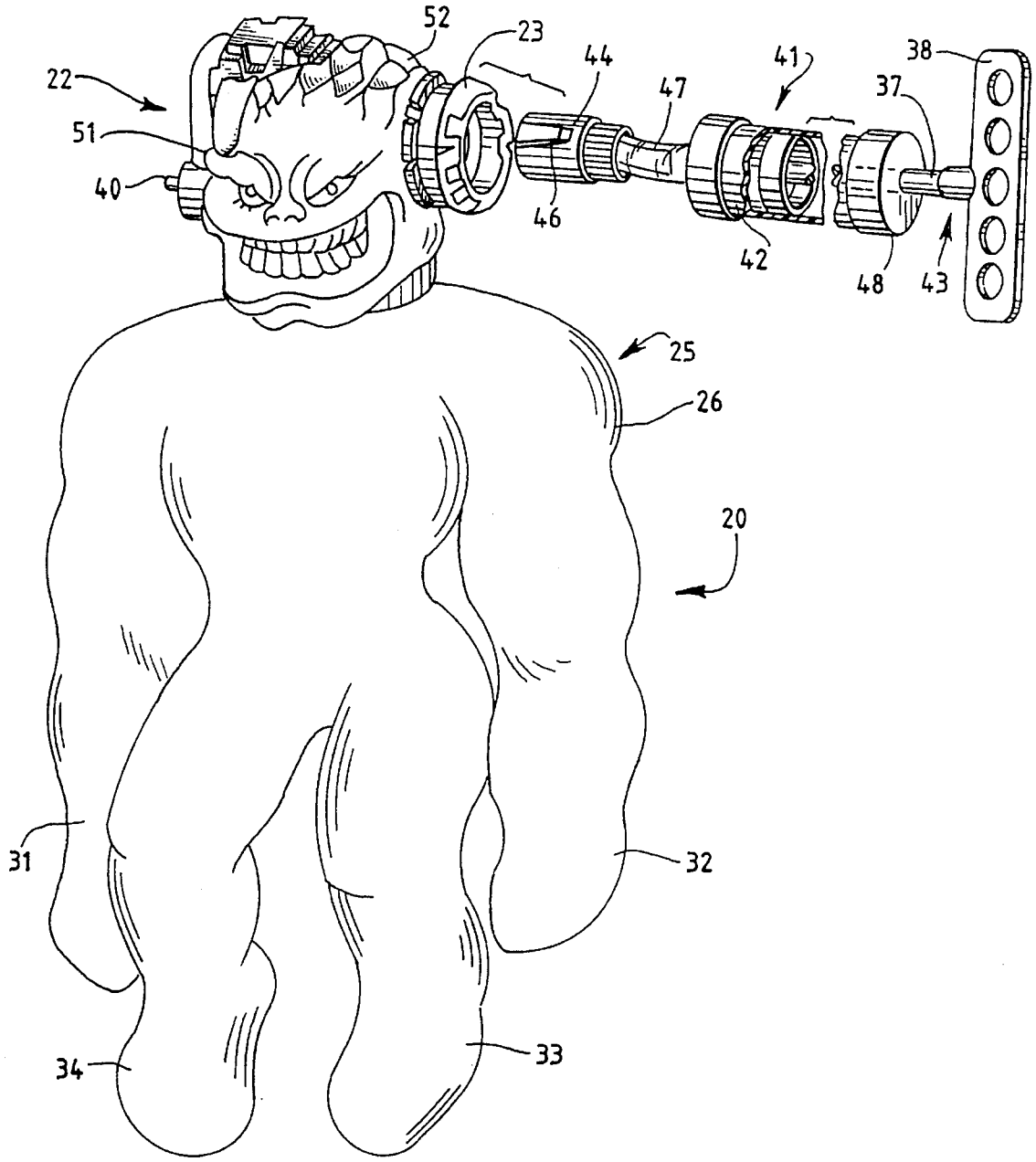
FIG. 1 is a perspective view of an embodiment of a toy figure in accordance with the present invention.

Referring initially to FIG. 1, there is illustrated an embodiment of a toy figure (generally designated 20) which is in the form of an animal having a head 22 and a body 25. In the embodiment of FIG. 1, the body 25 has movable limbs similar to a human, in the form of arms 31 and 32 and legs 33 and 34. The head 22 includes (a) a vacuum or pressure release button or switch 40 and (b) a vacuum port or pump port 3, which preferably includes a circular opening in the head 22. The pump port 23 preferably communicates with both (1) a substantially airtight manifold assembly on the interior of the head 22 (shown in FIG. 2) and (2) an attachable pressure reducing device, such as a pump 41.

The body 25 of the toy figure 20 is preferably constructed of an elastic material which forms a skin 26. The outer covering of the body may be referred to herein as "skin"; however, as stated above, the toy figure of the present invention is not limited to figures which have skin in the biological sense, because the inventive toy figure can be an inanimate object. The skin 26 of the body 25 may be formed to have hair or fur on the skin. The skin 26 may also have a pattern or contour, for example to resemble the look and feel of leather.

The skin 26 may be formed of any suitable elastic material. However, the material comprising the skin 26 preferably does not allow the passage of significant amounts of air through the skin, so that the interior of the body 25 is preferably rendered substantially airtight, and more preferably completely airtight.

The skin 26 preferably has both (a) sufficient ability to be elongated (e.g., to about 4 to about 5 times the unstretched length of the material) and (b) sufficient strength to resist to tearing when stretched and twisted. The skin may have a thickness in the range of about 0.027 inch to about 0.034 inch; however, this thickness is completely variable depending, for example, upon the size and shape of the toy figure, the filling material which is utilized, and the desired strength of the skin.

Examples of materials suitable for use as the skin 26 include various natural and synthetic compounds, such as latexes and vinyl compounds. Suitable materials include the Kraton™ materials (styrene-butadiene elastomer) made by Shell Chemical Company of Houston, Tex. Natural latexes, preferably containing antioxidants, are the preferred materials used for the skin 26.

The shape of the body is selected according to the particular type of toy figure that is desired. In the embodiment of FIG. 1, the body 25 of the toy figure 20 has a muscular shape. The skin 26 preferably has sufficient memory that after being stretched, it will return to its original, shaped form. The diameter of the body 25 at any given place on the toy figure is preferably at least about 0.25 inch, so that the skin 26 can withstand the stress imposed by the molding and filling processes, in addition to the severe stress imposed by stretching the figure during use.

A filling or stuffing material is present in the interior of the body 25. The filling material preferably (a) helps to support and form the shape of the body 25 and (b) allows the toy figure 20 to be stretched and/or posed, in the manner described below. Suitable filling materials are preferably selected for desirable contouring, lack of sharp edges, and cost-effectiveness. The filling material is preferably, but not necessarily, granular in nature. The same filler material need not be used in the entire interior of the body 25.

Examples of useful filling materials include the following: peas, various beans and other legumes, seeds, marbles, rope, plastic bones, sand, polyethylene beads, sawdust, ground nut shells, ground cork, foam rubber, rubber bands, and various powdered materials. Substantially all of the moisture which may be present in a filling material is preferably removed (e.g., by drying) before use of the material in the body 25.

A preferred filling material is ground corncob. Corncobs generally include three layers: (1) a first layer made of the sockets which hold the corn kernels, (2) a second layer of hard material often called the "woody ring," and (3) a soft central core known as the pith. The ground corncob used as the filler for the invention is preferably made from the second, hard layer of material (the "woody ring") that, when ground, may be referred to as "grit." Grit generally can have a density in the range of about 15 to 30 pounds per cubic foot, for example. Suitable ground corncob is available from Coeval, Inc. of St. Joseph, Ill. or The Andersons Cob Products of Maumee, Ohio. Although various sizes of ground corncob may be utilized depending upon the desired visual and tactile effects, preferred products include product designation number 4 of Coeval, Inc. and product designation number 8 from The Andersons. The preferred Coeval, Inc. product, for example, has a size, as determined by the ASTM standard screening method, of between about 4 and 12 mesh and has a density of at least about 25 pounds per cubic foot.

In general, the smaller the toy figure, the smaller the desirable size of the particles of the filling material. However, the size of the filling material is completely variable depending upon the visual and tactile effects desired in the toy figure.

Sufficient filling material is preferably utilized so that the body 25 is substantially completely filled when the skin is in its "natural" or unstretched state. However, as with the size of the filling material, the amount of filling that is used is dependent upon the visual and tactile effects that are desired in the toy figure.

The exterior portion of the head 22 is preferably made of a hard plastic material selected, for example, on the basis of strength, cost, and the ability to retain paint or other decoration on its surface. Suitable materials for the head 22 include high impact polystyrene ("HIPS"), acrylonitrile-butadiene styrene copolymer ("ABS"), and polyvinyl chloride ("PVC"). HIPS is the preferred material.

The head 22 is preferably manufactured in two pieces, for example a front head piece 51 and a rear head piece 52, as shown in FIG. 1. The head pieces 51, 52 may be secured together by any suitable means, such as a multiplicity of screws, as described in greater detail below. The head pieces 51, 52 are preferably secured closely together so that the gap, if any, between the pieces is less than about 0.03 inch, and more preferably any gap is less than about 0.02 inch. The head pieces 51, 52 are also preferably secured with cruciform pins and bosses to an interior manifold assembly, as described below in detail with reference to FIGS. 2 and 3. The interior manifold assembly is associated with both the pressure release button 40 and the pump port 23.

The pressure on the interior of the body 25 can preferably be reduced with a pump 41 which releasably attaches to the pump port 23. The pump 41 can be a modified version of a sports pump typically used for filling basketballs and footballs with air. A commercially available pump may be modified by (a) reversing the interior piston/valve assembly so that driving or stroking of the shaft assembly draws air into, as opposed to out of, the pump, and (b) removing the valve which is typically located at the end of the pump and attached to a filling needle.

The pump 41 of FIG. 1 includes a pump body 42 and a shaft assembly 43. The shaft assembly 43 includes a metal rod or shaft 37 attached to a pump piston (not shown) at one end and a pump handle 38 at the other. A pump back 48 provides a positive stop for the shaft assembly 43 and encloses the interior of the pump body 42. The pump 41 has an end portion (generally designated 45), wherein a connector piece 44 is joined to the body 42 with a length of flexible tubing 47. The flexible tubing 47 is preferably made of a vinyl material.

The connector piece 44 preferably has a circular cross-section and has one or more outwardly extending tabs or pegs 46 which are engageable with circular slits or ribs in the circular pump port 23 (described in more detail below with reference to FIG. 2). The connector piece 44 can preferably be inserted into the port 23 and rotated (e.g., one-quarter of a clockwise turn) in order to temporarily secure the connector piece 44 to the port 23 during the "vacuuming" process, described below. Releasably securing the pump 41 to the head 22 is beneficial because the pump 41 tends to jostle during the process of being driven or stroked.

The pump 41 preferably has the ability to develop about 20 to about 25 in. Hg of vacuum after about 6 to about 10 strokes while attached to the vacuum port 23. However, the capability of the pump is variable depending, for example, upon the size of the toy figure and the desired quickness in removing air from the interior of toy figure 20.

The interior of the head 22 will now be described with reference to FIG. 2. FIG. 2 is a vertical cross-sectional diagrammatic view of taken along line 2—2 of FIG. 1; i.e., the view of FIG. 2 is a cross-section when looking at the front of the toy figure of FIG. 1.

Figure 2:
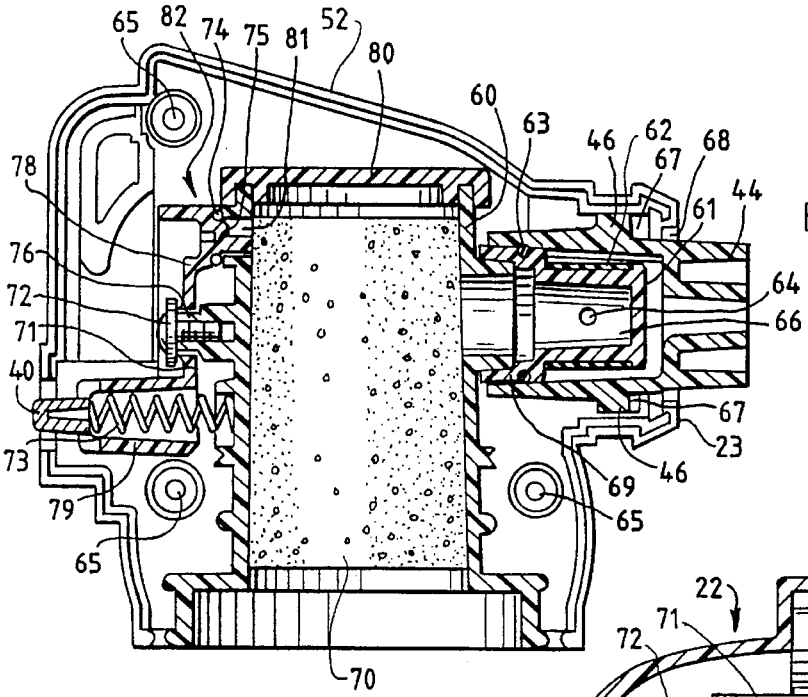
FIG. 2 is a vertical sectional view, taken along line 2—2 in FIG. 1 of an embodiment of a head of a toy figure, in accordance with the present invention.

In general, in the embodiment of FIG. 2, the toy figure 20 preferably has a manifold 60 which provides a single pathway for air to leave the figure and a single pathway for air to enter the toy figure 20. Located in the vacuum port 23 is a one-way valve opening 64 that allows air to leave the figure when the connector 44 is attached and the pump 41 is employed. A one-way vacuum relief valve 82 is preferably located opposite the vacuum port 23 and can be actuated by a trigger 71. The vacuum relief valve 82 allows ambient air to reenter the figure when the pressure release button 40 is pressed. An alternative arrangement to that shown in FIG. 2 would be to use a single two-way valve that is adapted to allow either the removal or the addition of air depending upon the desire of the user of the toy figure.

The rear head piece 52 has three screw sockets 65 which are used to attach the rear head piece 52 to the front head piece 51 with screws (not shown in FIG. 2). Attached to the interior of the rear head piece 52 is the head manifold 60, to which all of the interior elements of the head 22 are preferably attached. The manifold 60 preferably, although not necessarily, has a horizontal cross-section which is circular. A cap 80 preferably seals the top of the manifold 60. During manufacture of the toy figure 20, after the body 25 is filled with a suitable material (e.g, ground corncob), the cap 80 is preferably secured to the manifold 60 by any suitable means (e.g, a sonic shear weld or glue) to form an at least substantially airtight seal between the top of the manifold 60 and the cap 80, as shown in FIG. 2.

A vacuum port knob 61 is preferably attached at one side of the manifold 60. The vacuum port knob 61 can be (a) molded as an integral portion of the manifold 60 or (b) attached to an opening in the side of the manifold body 60 (as in the embodiment of FIG. 2). At the opposite side along the circumference of the manifold 60, the trigger 71 is preferably attached to the manifold 60. The vacuum port knob 61 preferably has a circular cross section and cooperates with the vacuum port 23 to receive the connector piece 44. (The only portion of the pump 41 shown in FIG. 2 is the connector piece 44.)

As described above, the inventive toy figure preferably includes a feature which helps in temporarily securing the connector piece 44 to the vacuum port 23. In the embodiment of FIG. 2, the two tabs 46 on the connector piece 44 can each engage a circular slit or a socket 67 in the pump port 23. Each circular slit 67 preferably is a depression, track, or socket which partially extends around the circumference of the circular pump port 23. The port 23 has an opening or recess 68 along a portion of its outer edge (i.e., the diameter of the circular opening at the port 23 is larger at 68). The opening 68 is located just outwardly of, and communicates with, the slit 67. The connector piece 44 can thereby be temporarily secured to the head 22 during the vacuuming process by (1) inserting the tabs 46 through the openings 68 into the slits 67 and (2) rotating the connector piece 44 away from the openings 68 (e.g., about a quarter of a clockwise turn).

In order to remove air from the interior of the toy figure 20, in the embodiment of FIG. 2, a one-way valve is preferably associated with the vacuum port 23. Such a valve utilizes the interior 66 of the vacuum port knob 61; the interior 66 communicates between the interior of the manifold 60 and at least one valve opening 64. Although only one valve opening 64 is viewable in FIG. 2, there are preferably two valve openings 64 from the interior 66. A strip of latex tubing 62 or other suitable material preferably tightly surrounds at least a portion of the length of the vacuum port knob 61 so as to cover the openings 64. As shown in FIG. 2, the tubing 62 covers the entire circumference of the knob 61, and forms a sleeve around the knob 61. Because the flexible tubing 62 releasably covers the openings 64, this system can act as a one-way valve to allow air to be removed from the interior of the toy figure 20 if sufficient vacuum or negative pressure is applied in the atmosphere around the opening 64.

At a location along the knob 61 inward (i.e., toward the manifold 60) of the tubing 62 there is situated an o-ring 63. The o-ring 63 is preferably located in a recess 69 of the knob 61 so that the o-ring 63 will be held in place. The o-ring 63 is preferably made of an elastomeric material. When the connector piece 44 is placed into the vacuum port 23 and over the vacuum port knob 61, the o-ring 63 preferably forms a substantially airtight seal with the connector piece 44, in order to enclose an area around the knob 61 and the opening 64.

Located on the interior of the manifold 60 is a plug 70. The plug 70 preferably prevents ground corncob or other filler from leaving the body 25 (not shown in FIG. 2) and entering into the interior of the manifold 60, because such filler would interfere with the action of the vacuum port and vacuum relief valves. The plug 70 is preferably made of an open cell polyurethane foam; however, any suitable material may be utilized. The foam material allows air to pass through the manifold 60, while trapping and holding corncob particles and dust.

In order to allow air into the interior of the toy figure 20, another one-way valve is preferably associated with the manifold 60. In the embodiment of FIG. 2, such a valve includes a trigger 71, which has an upper portion 78 and a lower portion 79 and is attached with a washerhead screw 72 to a post 76 which extends from the manifold 60. A plug 75 extends from the upper portion 78 of the trigger 71 and functions with the relief port 81 to form a vacuum relief valve, referred to generally as element 82. An o-ring 74 preferably encircles the circumference of the plug 75, in order to allow for a substantially airtight seal at the vacuum relief valve 82.

A trigger spring 73, preferably made of a flexible metal, applies pressure to the trigger 71 so that the o-ring 74 is pressed against the exterior of the manifold 60 near the port 81 to form a substantially airtight seal at the valve 82. Except for when air is being let into the interior of the manifold 60, the o-ring 74 is preferably pressed against the exterior of the manifold 60 near the port 81, as shown in FIG. 2.

As described above with reference to FIG. 1, the vacuum release switch 40 is attached to (or optionally an end portion of) the trigger 71, as shown in FIG. 2. The trigger 71 is secured to the manifold 60 with the screw 72, however, the trigger 71 is able to rock by pivoting on the post 76. (In other words, the post 76 is a fulcrum for the rocking of the trigger 71). In order to allow for both (a) a tight fit on the post 76 and (b) the ability for the trigger 71 to rock when the switch 40 is pressed, the outer end of the post 76 is partially cut away, as shown in FIG. 2.

The manifold 60, the cap 80, the trigger 71, the connector 44, the switch 40, and the vacuum port knob 61 are preferably made of a hard plastic material. Suitable materials include, for example, acrylonitrile-butadiene styrene copolymer ("ABS") and polyvinyl chloride ("PVC"). ABS is preferred for its strength and ability to either be sonic welded or solvent bonded. The o-rings 63, 74 and the tubing 62 may be made of any suitable elastomeric material.

Figure 3:
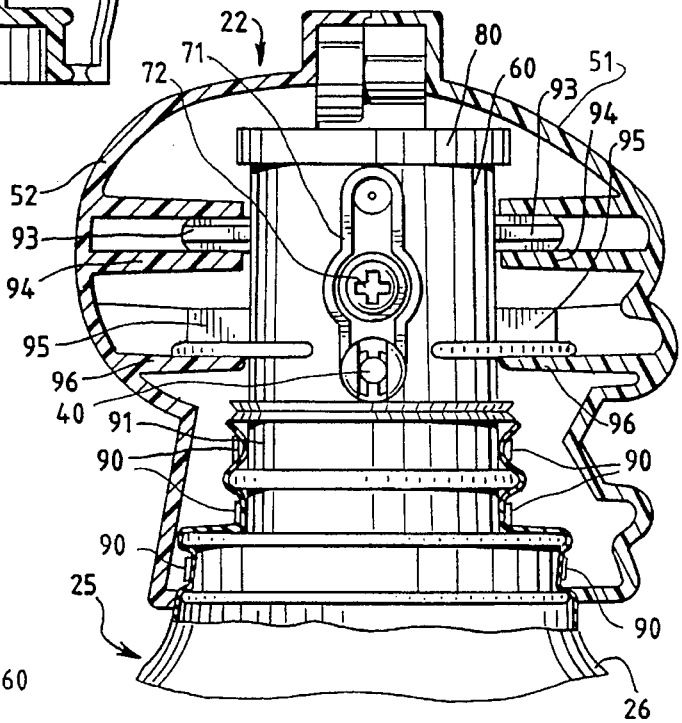
FIG. 3 is a vertical sectional view, taken along line 3—3 in FIG. 1 of an embodiment of a head of a toy figure, in accordance with the present invention.

Referring now to FIG. 3, wherein like elements of FIG. 3 are represented by the same numerals in FIGS. 1 and 2, the exterior of the head 22 is partially cut away in order to show an exterior view of the manifold 60, taken at the angle illustrated by line 3—3 in FIG. 1. FIG. 3 shows a view looking directly at the end of the vacuum release switch 40 at the side of the head 22.

As stated above, the front head piece 51 is joined to the rear head piece 52 with screws in multiple screw sockets 65 not shown in FIG. 3. The manifold 60 having the cap 80 is located in the interior of the head 22 formed by the head pieces 51, 52.

In order to secure the manifold 60 to the interior of the head 22 (i.e., the head pieces 51, 52), at least one cruciform pin and/or rib preferably projects outwardly from the manifold 60. At least one corresponding boss and/or rib on the head pieces 51, 52 intersects with the cruciform pin and/or rib to secure the manifold 60 to the interior of the head 22. For example, the manifold 60 can alternatively be secured to the interior of the head 22 by other suitable means, such as by gluing the indicated pieces.

In the embodiment of FIG. 3, the manifold 60 has two cruciform pins 93 and two manifold ribs 95 (a pin and a rib for each head piece 51, 52). The head pieces 51 and 52 each have a boss 94 and a rib 96 for accepting a pin and a rib, respectively. Thus, the manifold 60 is held in place relative to each head piece 51, 52 by: (1) a cruciform pin 93 inserted into a boss 94, and (2) a manifold rib 95 intersecting with a rib 96 on the interior of the head piece. However, alternative embodiments may be utilized with any combination of cruciform pins and manifold ribs. The use of at least one pair of manifold ribs is preferred, in order to facilitate handling of the manifold 60 during the manufacturing process.

As described above with reference to FIG. 2, the trigger 71 is secured to the post 76 (not shown in FIG. 3) with the washerhead screw 72. The vacuum release switch 40 (which would protrude from the head 22 if the entire head were shown in FIG. 3) is a portion of the lower portion 79 of the trigger 71. Alternatively, the switch 40 may be a separate piece attached to the trigger 71.

The manifold 60 has, at the lower portion 79 thereof, three grooves 91. In order to provide for a substantially airtight interior in the manifold 60 and the toy figure 20, the skin 26 is preferably attached to the manifold 60 with three cable ties 90 placed in the grooves 91, as shown in FIG. 3.

The cable ties 90 are commonly available devices used to bundle wires, and can be utilized much like hose clamps to attach the skin to the manifold neck ring, similar to the embodiment of FIG. 3. The length of the cable tie 90 depends upon the circumference of the manifold 60 at the location of the grooves 91; however, lengths of about 8 to about 10 inches are preferred. Any suitable tie may be used, for example cable ties manufactured under the trade designation Bar-Lok® by Dennison Manufacturing Co. of Framingham, Mass.

Figure 4:
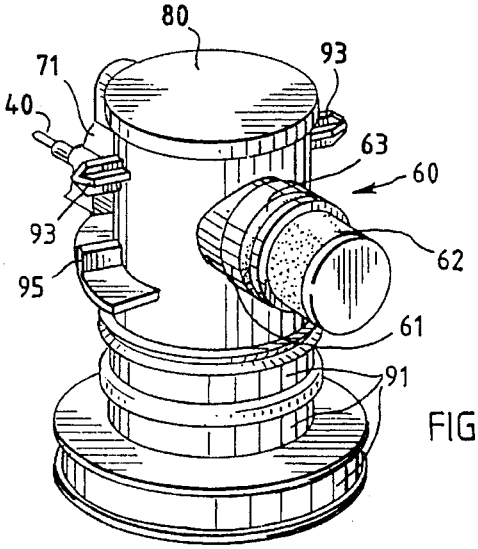
FIG. 4 is a perspective view of a manifold assembly useful in accordance with the present invention.

FIG. 4 illustrates a perspective view of the manifold 60, wherein like elements of FIGS. 2 and 3 are represented by like numerals in FIG. 4. As previously described, the manifold 60 has three grooves 91 to aid in the attachment of the skin 26 (not shown in FIG. 4). Two pins 93 and two ribs 95 can be used to secure the manifold 60 to the head of the toy figure (not shown). The view of FIG. 4 shows the knob 61 attached to a side of the manifold 60. As described above, the latex tubing 62 on the knob 61 forms a releasable valve for allowing the air to be removed from the interior of the toy figure. The o-ring 63 located on the knob 61 serves to form a substantially airtight chamber around the tubing 62 when a device for creating negative pressure (not shown) is placed around the knob 61 and in contact with the o-ring 63.

As mentioned above, the manifold 60 may be arranged to have a single, two-way valve through which air both enters and leaves the interior of the toy figure.

Referring to FIGS. 1–3 and 5, there will now be described a method of utilizing the "vacuum" feature of the toy figure described above. Like elements of FIGS. 1–3 are represented by the same numerals in FIG. 5.

Referring initially to FIG. 1, the toy figure 20 is in its natural or unaltered state, wherein the body 25 is preferably substantially unposable. In this first state, the body 25 preferably can be stretched because the skin 26 is made of a latex material; however, the skin 26 returns to its original state immediately after release of the stretching force (e.g., pulling on the arm 31 by the user) is removed. The toy figure may be utilized (e.g., played with) by the user in this first, natural state. However, additional entertainment can be provided if the toy figure is placed into its "vacuumed" or altered state, as will be described below.

The connector piece 44 of the pump 41 is inserted into the vacuum port 23 of the head 22. The connector piece 44 is preferably inserted so that (1) the pump connector tabs 46 enter their respective openings 68 and (2) the connector piece 44 is in contact with the o-ring 63, as shown in FIG. 2. The connector piece 44 is then rotated approximately a quarter of a clockwise turn, so that the tabs 46 are located in the slits 67, thereby temporarily securing the connector piece 44 to the head 22. Once this has been completed, the vacuum port knob 61 is preferably surrounded by a substantially airtight chamber defined by the connector piece 44, the o-ring 63, and a portion of the knob 61.

The pump handle 43 is preferably then stroked one or more times in order to remove air from the interior of the toy figure 20. When the pump handle 43 is stroked, the resulting negative pressure causes the tension of the latex tubing 62 on the knob 61 to be at least partially removed. The negative pressure caused by the pump 41 then causes air present on the interior of the body 25 and the manifold 60 to exit through the valve opening 64, through the body of the pump 41, and into the ambient atmosphere. As described above, the foam plug 70 preferably prevents ground corncob and any corncob dust from leaving the body 25 and entering the interior of the manifold 60.

Because the valve opening 64 and the latex tubing 62 act as a one-way valve (as described above), the pressure on the interior of the toy figure 20 (including the interior of the body 25) is reduced to a sub-atmospheric pressure.

When the interior pressure of the body 25 is reduced to a sub-atmospheric pressure, the skin 26 is forced against the ground corncob filling material (described in detail above). As the pressure within the body 25 decreases, the skin 26 becomes tighter around the filling material. The particles of the filling material are more strongly compressed both (a) against each other and (b) against the skin 26. After about six to about ten strokes of the pump, the toy figure 20 is preferably completely transformed into the second, "vacuumed" state.

Figure 5:
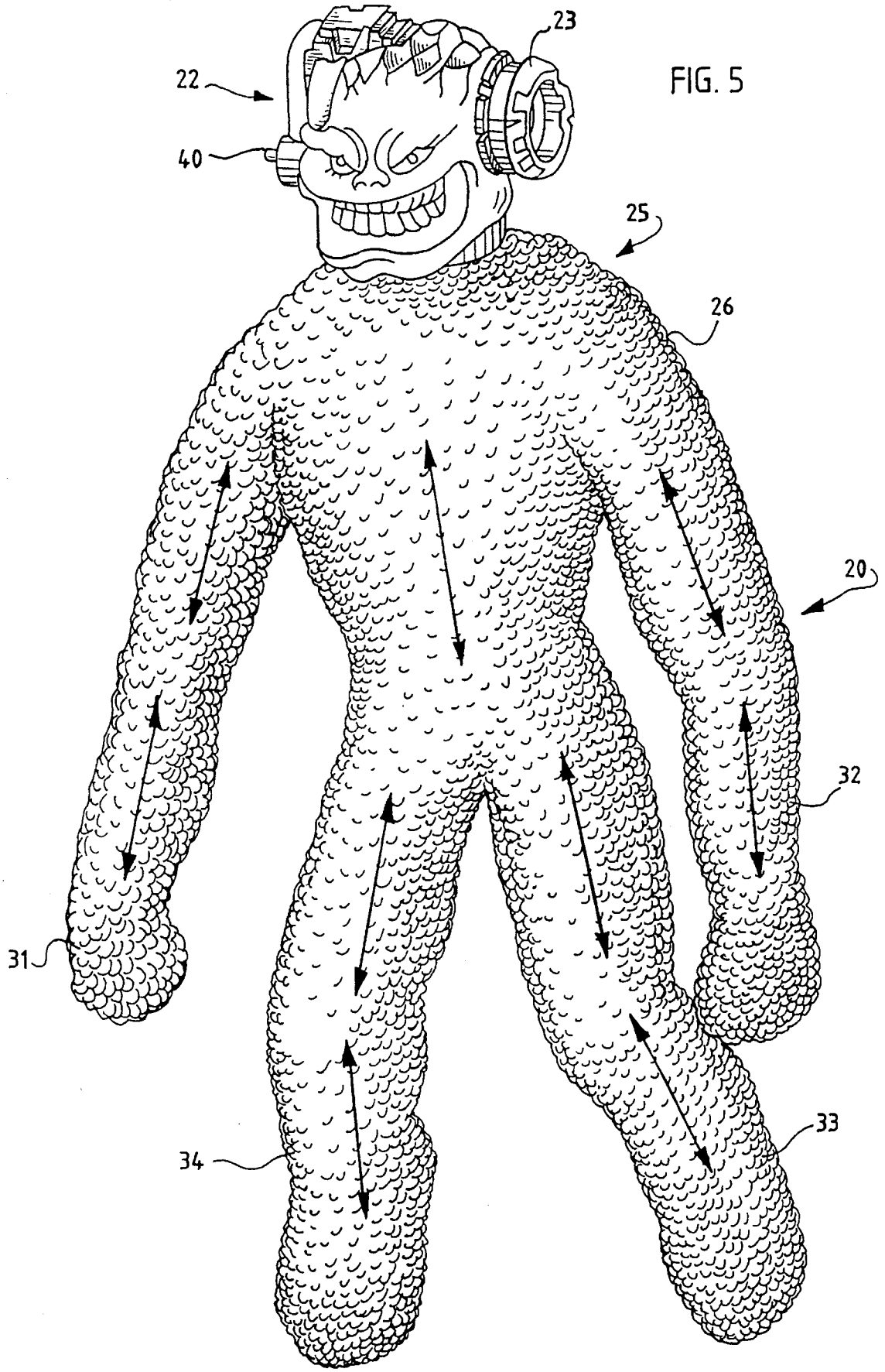
FIG. 5 is a perspective view of the embodiment of FIG. 1, wherein the figure is in a partially stretched position.

Once the toy figure 20 is in this second state, any portion of the toy figure 20 which is defined by the skin 26 is preferably able to be stretched and posed. For example, the arms 31, 32 and the legs 33, 34 of the body 25 may be stretched as shown in FIG. 5. Each arm, for example, can preferably be stretched to a length of about 6 to about 18 inches from an original length of about 4 to about 9 inches.

Once the arm, leg or other limb has been stretched, it is posable, i.e., it will preferably stay in that stretched condition until otherwise acted upon by the user. In addition, the limb can preferably be placed in a desired position. For example, the arms 27, 38 and the legs 33, 34 of the toy figure 20 might be posed in a position which resembles a running, sitting, or fighting position.

In addition, when the figure is in this second, "vacuumed" state, the tightness of the skin 26 around the filler material preferably provides an interesting texture to the skin. For example, if the figure is filled with a small, granular material, the figure preferably has the appearance of having bumpy skin. Various filler materials can be utilized to give different appearances.

The toy figure 20 (including the manifold 60, the skin 26, and the connection therebetween) is preferably sufficiently airtight so that after stretching, the toy figure can stay substantially in a stretched and posed position for at least about five minutes.

In order to return the toy figure 20 from its second or "vacuumed" state back into the first, natural state, the user activates the manual vacuum release switch 40, by pressing the switch 40 inwardly toward the center of the head 22. (The optimal manner for pressing the switch 40 is preferably at an angle slightly downwardly toward the feet of the toy figure 20, because the trigger 71 rotates about the post 76, as shown in FIG. 2.)

As described above in conjunction with FIGS. 2 and 3, pressing the switch 40 compresses the spring 73, allowing the lower portion 79 of the trigger 71 to move closer to the manifold 60. Because the post 76 acts as a fulcrum, the upper portion 78 of the trigger 71 moves away from the manifold 60 and the relief port 81. When the o-ring 74 loses contact with the outer portion of the relief port 81, this opens the valve 82. Because the pressure on the interior of the manifold 60 (and the body 25) is low relative to the ambient atmosphere, air enters into the manifold 60 and the body 25 via the valve 82.

If the user desires to only partially restore atmospheric pressure to the interior of the body 25, the user may release (i.e., let go of) the manual pressure applied to the manual vacuum release switch 40. This causes the lower portion 79 of the trigger 71 to rotate back to its original position, and the o-ring 74 of the upper portion 78 will again come into contact with the relief port 81. A substantially airtight seal is thereby reinstated.

The toy figure preferably meets all standards of toxicity, flame retardance, microbiological organisms, etc. known to those skilled in the art.

It should be understood that the entire body of the inventive toy figure need not have the ability to be converted into the "vacuumed" or posable state described above. For example, one or more body parts (e.g., a nose, neck or arms) could be stretchable and posable, without the rest of the body being connected to the airtight system described above. Also, it may be desirable to have two separate airtight vacuum systems (e.g., having two manifolds 60), so that each system can be independently placed into the above-described "vacuum" state by the user. Further, the manifold assembly need not be placed in the head of the toy figure, but instead could be adapted to be placed in any other convenient location on the body of the toy figure.

The foregoing description is given for clearness of understanding only, and no unnecessary limitations should be understood therefrom, as modifications within the scope of the invention will be apparent to those skilled in the art.

What is claimed is:

1. A toy figure, comprising:

(a) an exterior shell comprising a flexible material, said exterior shell defining a substantially airtight interior of said figure;

(b) a filler material disposed in the interior of said figure selected from the group consisting of granular materials, legumes, rope, plastic pieces, rubber bands, foam rubber, and powdered materials; and (c) means for reducing the pressure in said interior to a sub-ambient pressure.

2. The toy figure of claim 1 wherein:

said means for reducing pressure comprises means for rendering said figure posable.

3. The toy figure of claim 1 wherein:

said filler material comprises a granular material.

4. The toy figure of claim 3 wherein:

said filler material comprises ground corncob.

5. The toy figure of claim 1 wherein:

said filler is selected from the group consisting of peas, beans, seeds, marbles, rope, plastic bones, sand, polyethylene beads, sawdust, ground nut shells, ground cork, foam rubber, and rubber bands.

6. The toy figure of claim 1 wherein:

said exterior shell comprises natural latex.

7. The toy figure of claim 1 wherein:

said means for reducing pressure comprises a valve communicating between said interior and the exterior of said figure.

8. The toy figure of claim 1, further comprising:

a valve communicating between said interior and the exterior of said figure for allowing air to enter into said interior when the pressure in said interior is a sub-ambient pressure.

9. The toy figure of claim 8 wherein:

said means for reducing pressure and said valve comprise a two-way valve.

10. The toy figure of claim 1, wherein:

said granular material is selected from the group consisting of peas, beans, seeds, marbles, sand, polyethylene beads, sawdust, ground nut shells, ground cork, and ground corncob.

11. A toy figure capable of being rendered posable, comprising:

(a) an exterior shell comprising a flexible material, said exterior shell defining a substantially airtight interior of said figure;

(b) a granular filler disposed in the interior of said figure;

(c) a first, substantially airtight, releasable valve communicating between the exterior and said interior of said figure, said valve being adapted to be associated with means for reducing the pressure in said interior to a sub-ambient pressure; and (d) a second, substantially airtight, releasable valve communicating between the exterior and said interior of said figure, said valve being adapted to be associated with means for increasing the pressure in said interior from a sub-ambient pressure to ambient pressure.

12. A manifold assembly for reducing the pressure on an interior of a toy figure, comprising:

(a) an at least substantially airtight manifold body adapted to be disposable an interior of a toy figure and defining an interior portion;

(b) a first, exit valve adapted to be associated with means for reducing the pressure on the interior of said manifold body; and (c) a second valve comprising means for allowing ambient air to enter the interior of said manifold body when the pressure in said interior is at a sub-ambient pressure.

13. The manifold assembly of claim 12 wherein:

said first valve comprises a vacuum port knob having a conduit communicating between the interior of said manifold and the exterior of said manifold.

14. The manifold assembly of claim 13 wherein said conduit has an opening on said knob communicating with the exterior of said manifold, and further comprising:

a flexible covering disposed on said vacuum port knob and covering said conduit opening.

15. The manifold assembly of claim 14, wherein said means for reducing pressure comprises a connector piece, said manifold assembly further comprising:

an elastomeric o-ring disposed around said vacuum port knob for forming an at least substantially airtight chamber when in contact with said connector piece; and wherein said opening is located in said chamber when said knob o-ring is in contact with said connector piece.

16. The manifold assembly of claim 15 wherein:

said vacuum port knob has a proximal end and a distal end and said proximal end of said knob is adjacent to said manifold body; and wherein said opening is distal to said knob o-ring.

17. The manifold assembly of claim 16 wherein:

said flexible covering comprises latex tubing; and said tubing extends substantially the length between said knob o-ring and the distal end of said knob.

18. The manifold assembly of claim 16 wherein:

said flexible covering comprises latex tubing;

said tubing extends substantially the length between said knob o-ring and the distal end of said knob; and said flexible covering is in pressured contact with said knob.

19. The manifold assembly of claim 14 wherein:

said flexible covering is in pressured contact with said knob.

20. The manifold assembly of claim 19 wherein:

said flexible covering comprises means for releasably forming a substantially airtight seal at said conduit opening.

21. The manifold assembly of claim 19 wherein:

said means for reducing pressure comprises means for pulling said flexible covering away from said knob to release said seal at said opening.

22. The manifold assembly of claim 14 wherein:

said flexible covering comprises latex tubing.

23. The manifold assembly of claim 12, further comprising:

a filler material on the interior of said manifold body.

24. The manifold assembly of claim 23 wherein:

said filler material comprises foam.

25. The manifold assembly of claim 12 wherein:

said second valve comprises a plug releasably disposed in a valve opening, said valve opening communicating between the interior of the manifold and the exterior of said manifold.

26. The manifold assembly of claim 25 wherein:

said plug comprises means for forming an at least substantially airtight seal at said second valve.

27. The manifold assembly of claim 25 wherein:

said second valve further comprises an elastomeric o-ring disposed on said plug.

28. The manifold assembly of claim 12 wherein second valve comprises:

(a) a valve opening communicating between the interior of the manifold and the exterior of said manifold;

(b) a trigger piece associated with said manifold;

(c) a plug disposed on said trigger piece; and (d) means for placing pressure on said trigger piece to releasably secure said plug in said valve opening.

29. The manifold assembly of claim 28 wherein said trigger piece comprises a first portion and a second portion and said plug is disposed on said first trigger portion and wherein said means for placing pressure on said trigger piece comprises:

(a) a flexible spring associated with said second trigger portion; and (b) a post comprising means for attaching said trigger piece to said manifold.

30. A toy figure comprising the manifold assembly of claim 29.

31. The manifold assembly of claim 29 wherein:

said second valve further comprises a flexible piece associated with said plug.

32. The manifold assembly of claim 31 wherein:

said flexible piece comprises an elastomeric o-ring disposed on said plug.

33. The manifold assembly of claim 29 wherein:

said first valve comprises a vacuum port knob having a conduit communicating between the interior of said manifold and the exterior of said toy figure, wherein said conduit has an opening on said knob communicating with the exterior of said toy figure; and a flexible covering disposed on said vacuum port knob and covering said conduit opening.

34. The manifold assembly of claim 33, wherein said means for reducing pressure comprises a connector piece, said manifold assembly further comprising:

an elastomeric o-ring disposed around said vacuum port knob for forming an at least substantially airtight chamber when in contact with said connector piece; and wherein said opening is located in said chamber when said knob o-ring is in contact with said connector piece.

35. The manifold assembly of claim 34 wherein:

said flexible covering comprises latex tubing;

said vacuum port knob has a proximal end and a distal end and said proximal end of said knob is adjacent to said manifold body; and said opening is distal to said knob o-ring.

36. The manifold assembly of claim 29, further comprising:

a filler material on the interior of said manifold body.

37. The manifold assembly of claim 36 wherein:

said filler material comprises foam.

38. A toy figure, comprising:

(a) an exterior shell comprising a flexible material, said exterior shell defining a substantially airtight interior of said figure;

(b) a granular filler disposed in the interior of said figure; and (c) a manifold assembly for reducing the pressure on the interior of said toy figure, said manifold assembly comprising:

(1) an at least substantially airtight manifold body defining an interior portion;

(2) a first, exit valve adapted to be associated with means for reducing the pressure on the interior of said manifold body; and (3) a second valve comprising means for allowing ambient air to enter the interior of said manifold body when the pressure in said interior is at a sub-ambient pressure.

39. A toy figure, comprising:

(a) an exterior shell comprising a flexible material, said exterior shell defining a substantially airtight interior of said figure;

(b) a filler disposed in the interior of said figure, said filler comprising ground corncob; and (c) means for reducing the pressure in said interior to a sub-atmospheric pressure, said pressure reducing means comprising means for rendering said toy figure posable.

40. A toy figure, comprising:

(A) an exterior shell comprising a flexible material, said exterior shell defining a substantially airtight interior of said figure;

(B) a filler disposed in the interior of said figure, said filler selected from the group consisting of: granular materials, legumes, rope, plastic pieces, rubber bands, foam rubber, and powdered materials;

(C) a manifold assembly for reducing the pressure on the interior of said toy figure, said manifold assembly comprising:

(1) an at least substantially airtight manifold body defining an interior portion;

(2) a first, exit valve adapted to be associated with means for reducing the pressure on the interior of said manifold body; and (3) a second valve comprising means for allowing ambient air to enter the interior of said manifold body when the pressure in said interior is at a sub-ambient pressure, said second valve comprising (a) a valve opening communicating between the interior of the manifold and the exterior of said toy figure, (b) a trigger piece associated with said manifold, (c) a plug disposed on said trigger piece, and (d) means for placing pressure on said trigger piece to releasably secure said plug in said valve opening;

wherein said trigger piece comprises a first portion and a second portion and said plug is disposed on said first trigger portion and wherein said means for placing pressure on said trigger piece comprises a flexible spring associated with said second trigger portion; and (D) means for reducing the pressure in said interior to a sub-ambient pressure.

41. The toy figure of claim 40 wherein:

said means for reducing pressure comprises means for rendering said figure posable.

* * * * *